US006088466A

United States Patent [19]

Proni

[11] Patent Number: 6,088,466

[45] Date of Patent: Jul. 11, 2000

[54] AUDIO VOICE COIL ADAPTOR RING

[76] Inventor: Lucio Proni, 2571 Mayfair La., Weston, Fla. 33327

[21] Appl. No.: 09/022,583

[22] Filed: Feb. 12, 1998

Related U.S. Application Data

[63] Continuation-in-part of application No. 08/580,764, Dec. 29, 1995, Pat. No. 5,734,734.

[51] Int. Cl.[7] ..... H04R 25/00

[52] U.S. Cl. ..... 381/397; 381/420; 381/412; 381/414; 381/398

[58] Field of Search ..... 381/407, 403, 381/409, 432, 397, 398, 412, 420, 414, FOR 159, FOR 154

[56] References Cited

U.S. PATENT DOCUMENTS

| | | | |
|---|---|---|---|
| 4,118,605 | 10/1978 | Kobayachi | 179/115.5 |
| 4,680,800 | 7/1987 | Bank et al. | 381/194 |
| 4,765,968 | 8/1988 | Kreitmeier | 381/204 |
| 5,111,510 | 5/1992 | Mitobe | 381/193 |
| 5,323,469 | 6/1994 | Scholz | 381/204 |
| 5,424,496 | 6/1995 | Kreitmeier | 181/161 |
| 5,731,805 | 3/1998 | Saiki et al. | 381/192 |
| 5,734,734 | 3/1998 | Proni | 381/194 |

*Primary Examiner*—Curtis A. Kuntz
*Assistant Examiner*—Dionne N. Harvey
*Attorney, Agent, or Firm*—Holland & Knight LLP

[57] ABSTRACT

A voice coil adaptor ring and loudspeaker system of the moving coil type including a cone diaphragm supported by a frame, a voice coil former for supporting a voice coil, and a lower suspension for securing and centering the voice coil former in a magnetic gap while it is displaced by a magnetic circuit. The voice coil adaptor ring is mounted over the voice coil former and comprises a substantially cylindrical sleeve having a lower diameter for fitting over the top plate; at least one ledge extending outward from said sleeve for supporting the cone and lower suspension; an inherent gap for receiving epoxies; and a plurality of venting passages in fluid communication with a cap volume defined by the cone and dust cap for venting hot air from the cap volume.

11 Claims, 11 Drawing Sheets

AUDIO VOICE COIL ADAPTOR RING

CROSS-REFERENCE TO RELATED APPLICATIONS

This application is a continuation-in-part of a U.S. application Ser. No. 08/580,764, filed Dec. 29, 19995 now U.S. Pat. No. 5,734,734.

STATEMENT REGARDING FEDERALLY SPONSORED RESEARCH OR DEVELOPMENT

Not applicable.

BACKGROUND OF THE INVENTION

1. Field of the Invention

The present invention relates generally to the field of loudspeakers, and in particular, to a voice coil adaptor ring for mating the cone and spider for increased strength and efficiency.

2. Description of Related Art

Improved loudspeaker performance and more shallow speaker designs are constant goals in the car audio market. Simultaneously achieving these goals is difficult. To improve performance, higher excursions and more reliable suspension systems are desired, but require deeper speaker dimensions. Since mounting space in automobiles is limited, larger speaker dimensions are undesirable. In addition, physical clearance limitations for the speaker's moving assembly make it difficult to decrease the speaker's depth. Adequate clearance for the moving assembly is needed between the spider and top plate and the voice coil and bottom/back plate, as discussed more fully herein. Because of these and other limitations, achieving a more shallow speaker without compromising excursion and performance has been difficult. Accordingly, a loudspeaker with enhanced performance and a more shallow design would be well received. Thus, there exists a need for a speaker having these attributes. For a better understanding on how the instant invention addresses these needs, a discussion of general speaker construction follows.

With reference to FIG. 1, a conventional loudspeaker 20 generally comprises a support frame 22, a cone 24 with or without a dust cap 26 bridging across the cone 24, a suspension system, a voice coil 40, a voice coil bobbin/former 43, a top plate 37, a back/bottom plate 39, and a vented pole piece 41. Sometimes the cap comprises an integral part of the cone. The voice coil 40 is wound about the voice coil former 43 which resides in a defined annular magnetic gap. The magnetic circuit linearly cycles or displaces the voice coil former 43 in this gap. In the conventional speaker, the cone 24 is attached to the voice coil former above the coil 40 at its lower end and to the frame at its upper end. The back/bottom plate 39 is sometimes bumped or stepped, as opposed to flat, to increase excursion by allowing the voice coil 40 to travel below the magnet without making contact and causing damage. That is, additional clearance is obtained. However, a stepped/bumped back plate is more expensive to make. Also, bumped back plates have bump depth limits and can only be made so deep due to production methods. As a consequence, the designer may need to stack magnets for increased voice coil-to-back plate clearance. However, extra magnets are expensive, and may result in undesirable changes in motor system behavior, such as too much motor strength for the desired application.

Something inherent in every speaker is the magnetic gap center line. The magnetic gap is defined by the top plate and pole piece of the loudspeaker. The magnetic gap height is generally taken as the thickness of the top plate. Therefore, assuming uniform flux density across the air gap (an idealized, but practical premise), the magnetic gap center line bisects the top plate's thickness.

The suspension system of the loudspeaker controls linear motion of the cone and provides a major centering force for preventing the voice coil from rubbing and rocking against the pole piece. The suspension system normally comprises a surround 28 (upper or outer suspension) and a spider 38 (lower or inner suspension). The surround 28 is a mechanical device which holds the outer edge of the diaphragm/cone of the loudspeaker and is often referred to as a "roll." One purpose of the surround is to help keep the cone 24 centered and to provide an upper portion of the restoring force that keeps the voice coil in the magnetic gap. The surround also provides a damped termination for the edge of the cone. The spider 38 comprises a lower/inner suspension member that helps to keep the voice coil concentric to the pole piece. The spider also provides a portion of the restoring force that maintains the voice coil within the magnetic gap. Thus, the stiffness and structural integrity of the spider can greatly affect the loudspeaker's resonance. The spider also provides a barrier for keeping foreign particles away from the gap area. A spider 38 is commonly constructed from treated corrugated fabric.

In conventional loudspeakers, the cone and spider make a sheer attachment directly to the voice coil. That is, the cone and spider are adhered with glue to the vertical, cylindrical surface of the voice coil without any mechanical anchor or reinforcement. This results in a relatively weak adhesive joint. Therefore, the possibility of mechanical failures in the cone and spider is likely since the stress distribution around the glue joint is high.

In speakers having smaller voice coils, the inherent weakness of the glue joint is more critical. Spiders are typically made from resin treated cloth materials. When the inner diameter of the spider gets smaller, fewer strands of material intersect the cutout. Since the glue joint lies on this small circumference, very little spider material is captured. This places the spider material under greater stress than normal. This high-stress condition could cause the spider itself to fatigue prematurely. Since the spider is typically called on to center the moving assembly and limit cone motion at the extremes of excursion, a compromised spider could cause a catastrophic failure.

Another problem associated with conventional speakers is that they require pole vents for venting air pressure. Pole vents comprise holes bored directly through the pole piece 41. These vents are used to relieve air pressure that builds up beneath the cone volume. Without a pole vent, audible noise can be introduced as the trapped air under the dust cap tries to escape during large cone excursions. However, in speakers having a small diameter voice coil, the amount of metal in the pole piece can limit the magnetic flux in the speaker. Consequently, using a pole piece with large amounts of metal removed for pole vents can radically alter the performance of the magnetic circuit.

A vented pole piece further affects the thermal behavior of the speaker. The steel contained in the pole piece provides an effective thermal sink for the voice coil. Machining a pole vent in the pole piece increases thermal resistance of the sink, lowering the power handling capability of the loudspeaker.

In addition to the foregoing, the conventional speaker has inherent limitations which has made it difficult to achieve enhanced or sustained speaker performance in a shallow speaker design. Adequate clearance is needed between the voice coil and back plate and the spider and top plate for cycling the moving assembly. The positioning and shape of the top plate is also important as it affects clearance and the positioning of the magnetic center line. The spider suspension needs to be attached at points which facilitate decreased depth. Finally, decreasing the depth of a speaker can affect the positioning of the magnetic gap center line. In contrast with the present invention, the background art has failed to address or solve these issues.

A vented adaptor ring and modified top plate system, in accordance with the disclosure herein, is not contemplated by known speaker designs and would solve the above-noted problems. Several loudspeaker designs are contemplated in the background art; however, none of these references solve the above-noted needs. For example, Mitobe (U.S. Pat. No. 5,111,510) discloses a speaker and manufacturing method therefor including a diaphragm integrally combined with a first frame piece and a driver unit integrally combined with a second frame piece. Saiki et al. (U.S. Pat. No. 5,371,805) discloses a speaker and speaker system comprising a diaphragm secured to a first periphery of an edge member and a frame secured to a second periphery of the edge member. Scholz (U.S. Pat. No. 5,323,469) discloses a conical loudspeaker having a conical stabilizing element joined between an underside of a speaker membrane and an outside surface of a speaker moving coil carrier. Kreitmeier (U.S. Pat. No. 5,424,496) discloses an electromagnetic converter comprising an internal magnet system, a moving coil and tubular segment. Kreitmeier (U.S. Pat. No. 4,764,968) discloses a disk-like diaphragm made from a conical plastic film and provided with vacuum formed support members which extend up to the disk-like radiating layer. Kobayashi (U.S. Pat. No. 4,118,605) discloses a voice coil mount structure comprising a cylindrical member, which secures a diaphragm, a damper, and a coil winding. Bank et al. (U.S. Pat. No. 4,680,800) discloses a build ring that is mounted to the voice coil and secures the diaphragm and spider. Kobayashi and Bank, as well as the other noted references, do not provide any structure for ventilating air pressure from beneath the cone volume, or structure that facilitates the design of a shallow speaker without compromising performance.

The problems recited in the background art are addressed by the invention in the parent case, U.S. application Ser. No. 08/580,764. Although the parent invention solves many problems associated with high excursion loudspeakers and spider attachment, the inventor herein has discovered additional structure which improves loudspeaker performance and reliability in shallow speaker designs. The foregoing art fails to address the need for a high performance speaker in a shallow design. The depth of a loudspeaker, especially in the car audio market, is always in need of improvement. Decreasing the depth of a loudspeaker is limited by factors such as lack of clearance within the speaker, positioning and shape of the top plate, and location of the magnetic gap center line. The flat shape of typical top plates also limits the range of depth that can be sacrificed because of the location of the magnetic gap center line. The instant invention has adopted portions of the parent loudspeaker design and combined it with novel features to arrive at a unique, unobvious adaptor ring and speaker design that resolves the noted objectives.

BRIEF SUMMARY OF THE INVENTION

An object of the present invention is to provide a structure that facilitates the secure attachment of a cone edge, spider, and voice coil for improved loud speaker performance.

An additional object of the instant invention is to provide a more shallow loudspeaker without compromising excursion and performance.

Another object of the invention to provide a voice coil adaptor ring that provides a stronger joint for the cone, spider suspension, and voice coil.

A further object of the instant invention is to provide an adaptor ring that moves the voice coil up into the cone volume to facilitate a more shallow speaker design.

It is also an object of the invention to provide a voice coil adaptor ring that makes it possible to use relatively small voice coils in low frequency speakers.

It is a further object of the invention to provide a voice coil adaptor ring that eliminates the need for machining pole vents in pole pieces.

It is an additional object of the invention to provide a voice coil adaptor ring that facilitates use of a larger inner diameter spider that is more resistant to rocking.

It is another object of the invention to provide a voice coil adaptor ring that makes it possible to reduce the cone angle for a given voice coil size to strengthen the cone.

It is still an additional object of the invention to provide a voice coil adaptor ring that provides a structure that eliminates the need for adhering the spider and cone to the voice coil former.

It is yet another object of the instant invention to reduce the number of failure points in a loudspeaker and the probability of loud speaker failure.

Another object of the instant invention is to reduce stress in the joints securing the spider and cone.

A further object of the instant invention is to provide a voice coil adaptor ring that allows the cone to be attached further out from the voice coil former.

According to these and other objects, the present invention comprises a voice coil adaptor ring in a loudspeaker which incorporates the voice coil adaptor ring. The adaptor ring comprises a substantially cylindrical sleeve having an upper diameter and a lower diameter and cylindrical walls which are vented. The adaptor ring also includes at least one ledge extending radially outward from the cylindrical wall for supporting the spider and/or cone. Additional ledges may be employed for supporting the cone in other portions of the loudspeaker. The loudspeaker comprises a cone, a frame supporting the cone's upper end, a voice coil having a former and coil wound therearound, the new adaptor ring mounted to the former, a lower suspension (spider) connected at one end to the frame and at the other end to the adaptor ring for centering the voice coil system, and a magnetic circuit including a top plate having a vertical section projecting upward along the pole piece. The loudspeaker may also incorporate a dust cap bridging across the cone.

The ledge(s) is/are preferably substantially horizontal to provide structural support, minimize spider deflection, and create an enlarged surface area for adhering the spider and cone. A ledge provides a surface for securing the spider and cone that is superior to gluing it directly to the vertical wall. By providing a substantially horizontal ledge, adhesives may be applied to both the upper and lower surfaces of the cone and spider to increase the adhesive contact area. In addition, the spider can be locked in place on the ledge when the cone is attached thereto on the same ledge. This greatly reduces the possibility of failures. It should be noted that the ledge or ledges may be oriented at other angles without departing from the scope and spirit of the invention so long as the noted objectives are achieved. The cone and spider may be attached to the same ledge. A substantial decrease in stress on the glue joints is realized by the structure and method of the instant invention. There is better stress distribution across the joint and increased stability provided by the adaptor ring ledge, which has been largely proven on production units.

The adaptor ring defines an upper diameter and a lower diameter. The lower diameter is larger than the upper diameter to allow the ring to move over the riser top plate during use. This increases the available clearance between the motor structure and adaptor ring and allows a voice coil to be moved up into the cone volume, resulting in a more shallow speaker design without sacrificing performance. The upper diameter is adapted for receiving and attaching the voice coil former. The new adaptor ring design, in conjunction with the top plate design, improves the speaker performance and excursion range for a shallow diaphragm.

In the preferred embodiment, the cylindrical wall is substantially continuous and defines a plurality of apertures. The wall rises upward from the lower diameter and tapers toward the upper diameter. The tapered section defines the venting apertures. However, the venting apertures may be defined in other locations so long as a clear passage is provided. The adaptor ring may also be described as having a lower ring joined to an upper ring by a vented cross member. In either event, the adaptor ring preferably has a unibody structure.

In an alternative embodiment, a plurality of ribs or support members join an upper ring and lower ring, which define the upper and lower diameters, respectively, and provide a plurality of venting passages. The venting passages may also be defined as openings in the wall of the adaptor ring. The venting passages of the instant invention eliminate the need for machining a pole vent in the pole piece, thereby reducing manufacturing time and cost. A solid pole piece offers an increase in magnetic circuit efficiency, as well as a less resistant thermal path for heat transfer from the voice coil. An improvement in the heat transfer from the voice coil increases the power rating of the driver, making the speaker more reliable. It has been determined that when a fairly porous spider is paired with the venting passages, air may exit noiselessly from the cone volume.

The loudspeaker of the instant invention is adapted to incorporate the new adaptor ring. The riser top plate has been reconstructed to a substantially L-shaped geometry. The vertical leg projects upward along the pole piece and the lower leg attaches to the magnet. The lower diameter of the adaptor ring concentrically fits and moves over the upper leg of the top plate. This allows the motor structure and voice coil to be moved upward in the speaker for a more shallow speaker design. It can also achieve additional clearance for actuating the voice coil and adaptor ring structure if desired. Traditionally, the magnetic gap center line is closer to the magnet. The riser plate design translates the magnetic gap center line upward with respect to the magnet and provides a larger top plate surface area across from or in proximity to the voice coil for better heat transfer. In addition, the riser top plate allows larger magnetic gap height with reduced metal plate thickness. Accordingly, greater excursions are possible. When the adaptor ring is installed over the voice coil former, an inherent gap remains between the upper interior wall of the ring and the voice coil former. This gap is filled with glue to adhere the adaptor ring to the voice coil former. Other alternatives may be employed for attaching the voice coil to the adaptor ring, such as soldering, hardware, tape, or alternative placement of the adhesive.

The adaptor ring may also include at least one wire channel, or slots along the interior wall of the adaptor ring to form channels when the adaptor is mounted to the voice coil former, for running the lead out wires. In addition, certain support members joining the upper cover portions of the adaptor ring may include notches for relieving strain on the wires. In the alternative, the wire may be passed through one of the venting passages. The ring may also include a textured or ribbed surface for increased surface tension when applying adhesives.

While the instant invention is described with reference to loudspeakers having small voice coils and speaker caps, the voice coil adaptor ring may be incorporated with other loudspeakers for improved performance and strength.

The invention is described in detail below with reference to the accompanying drawings, in which:

DETAILED DESCRIPTION OF THE INVENTION

Figure 1A:
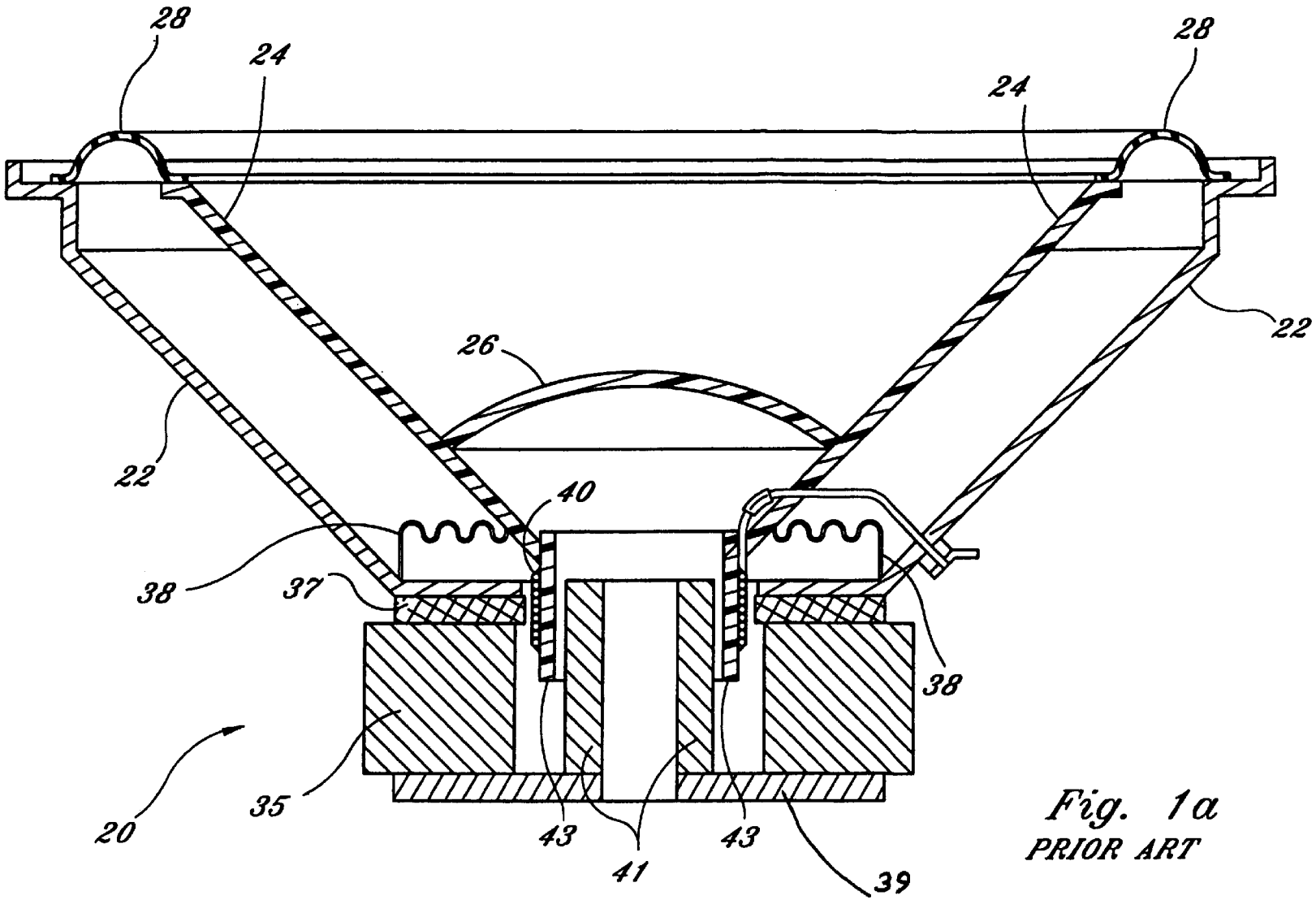
Fig. 1a PRIOR ART
FIGS. 1*a* and 1*b* depict cross-sectional views of prior art loudspeakers.
Figure 1B:
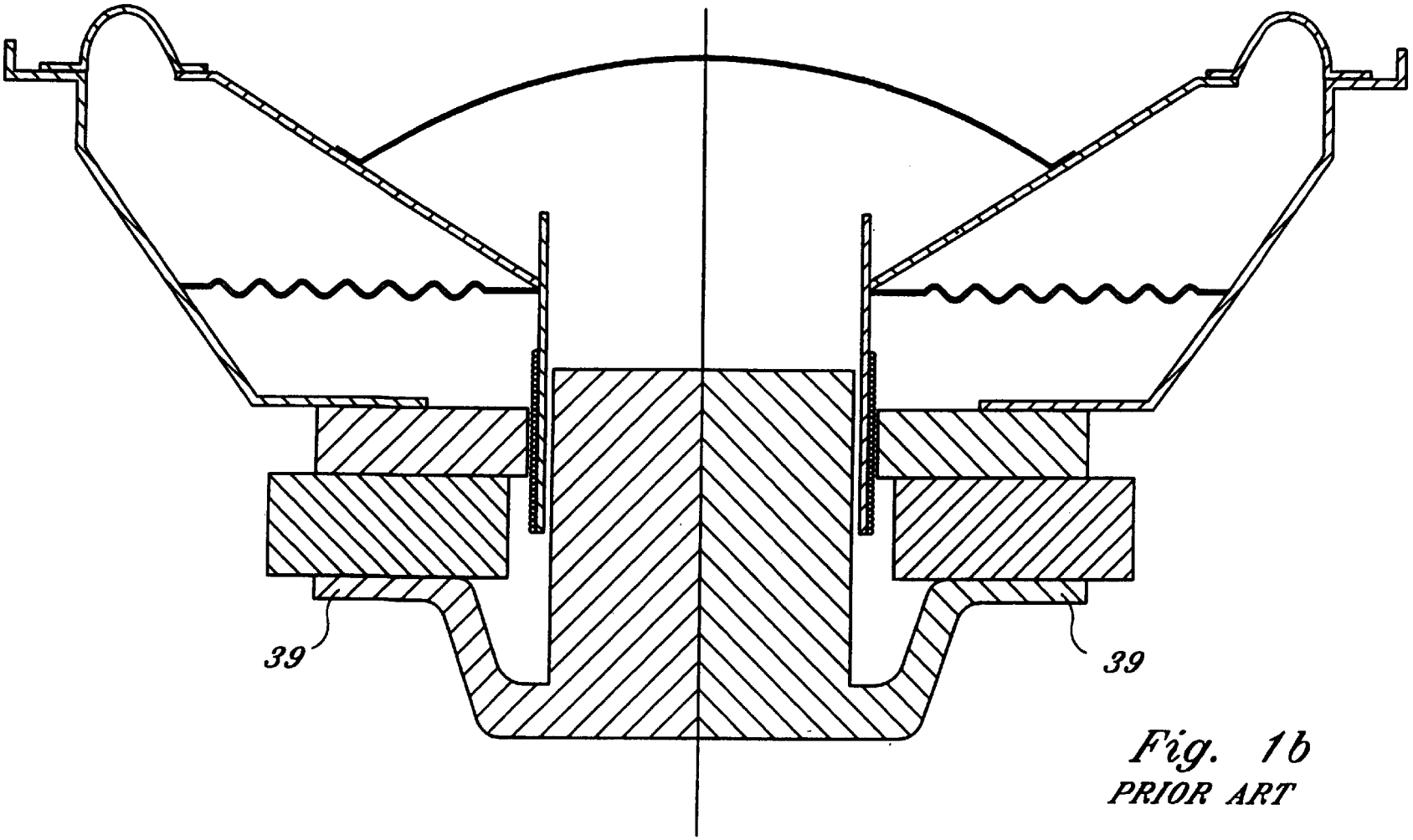
Fig. 1b PRIOR ART
Figure 2A:
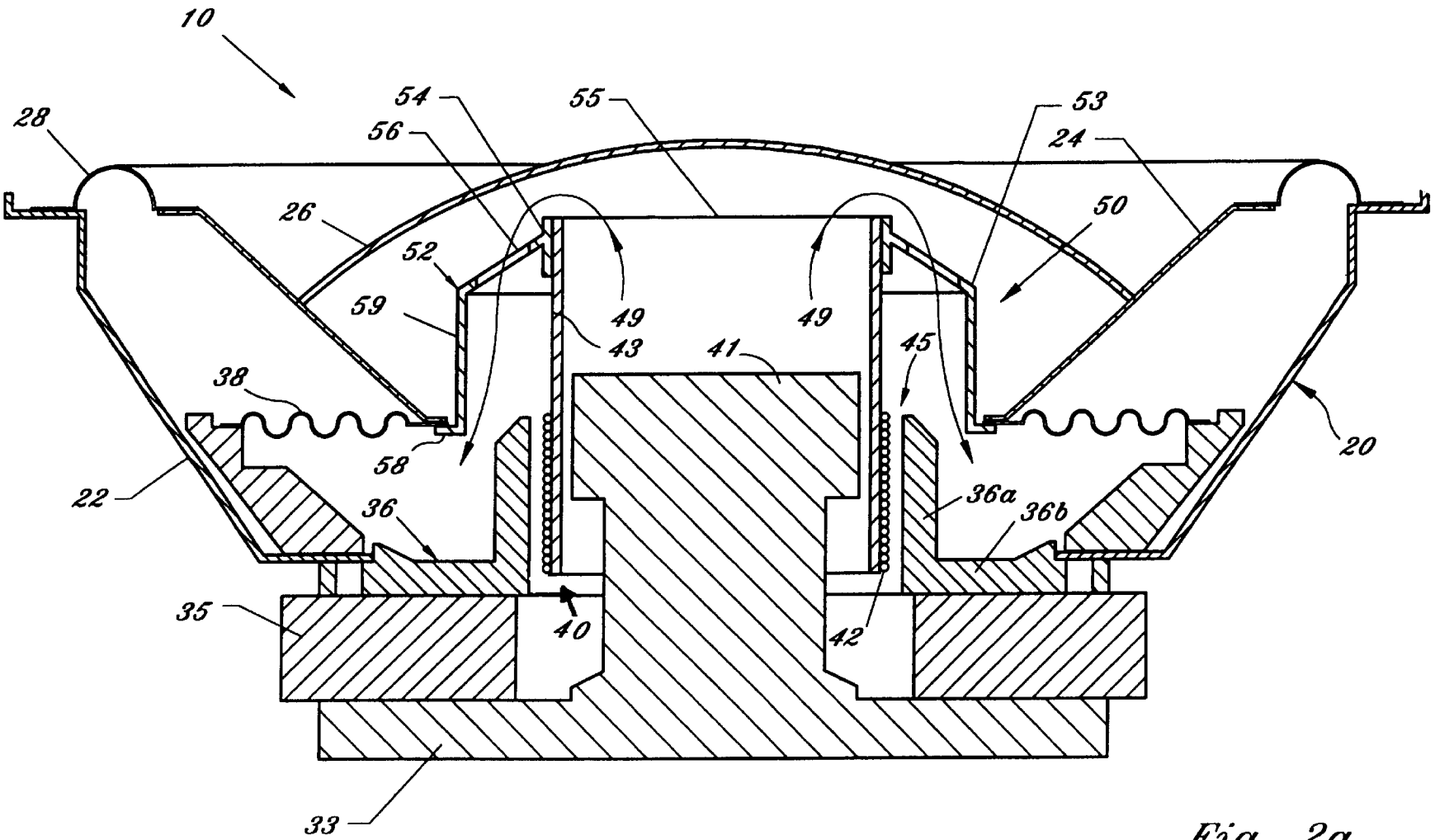
FIG. 2*a* is a cross-sectional view of the preferred embodiment of the loudspeaker and voice coil adaptor ring of the instant invention, as installed in the loudspeaker.

With reference to the drawings, FIGS. 2*a*–12 depict the various embodiments of the voice coil adaptor ring and loudspeaker system 10 incorporating the adaptor ring, in accordance with the instant invention. Referring to FIG. 2*a*, the loudspeaker 20 of the instant invention incorporates the voice coil adaptor ring 50 and comprises a cone-shaped diaphragm 24 (cone), which may or may not include a cap 26, a frame 22 supporting the upper end of the cone 24, a voice coil 40 comprising a winding 42 wrapped around a voice coil former 43, the voice coil adaptor ring 50 attached to the upper end of the former 43, an upper suspension 28, a spider 38, and a magnetic motor structure. The spider 38 is attached and adhered to the adaptor ring 50 to provide a centering force for the former 43 and voice coil 40. The motor structure comprises at least one magnet 35, a solid pole piece 41, a riser top plate 36, and a back plate 33. The pole piece 41 may be staggered, T-cut, or under-cut to prevent leakage of magnetic flux. The top plate 36 may also be staggered to prevent leakage, as discussed infra. A magnetic gap 45 exists between the top plate 36 and the pole piece 41. Together, the adaptor ring 50 and spider suspension 38 center the voice coil 40 in this gap.

Figure 3:
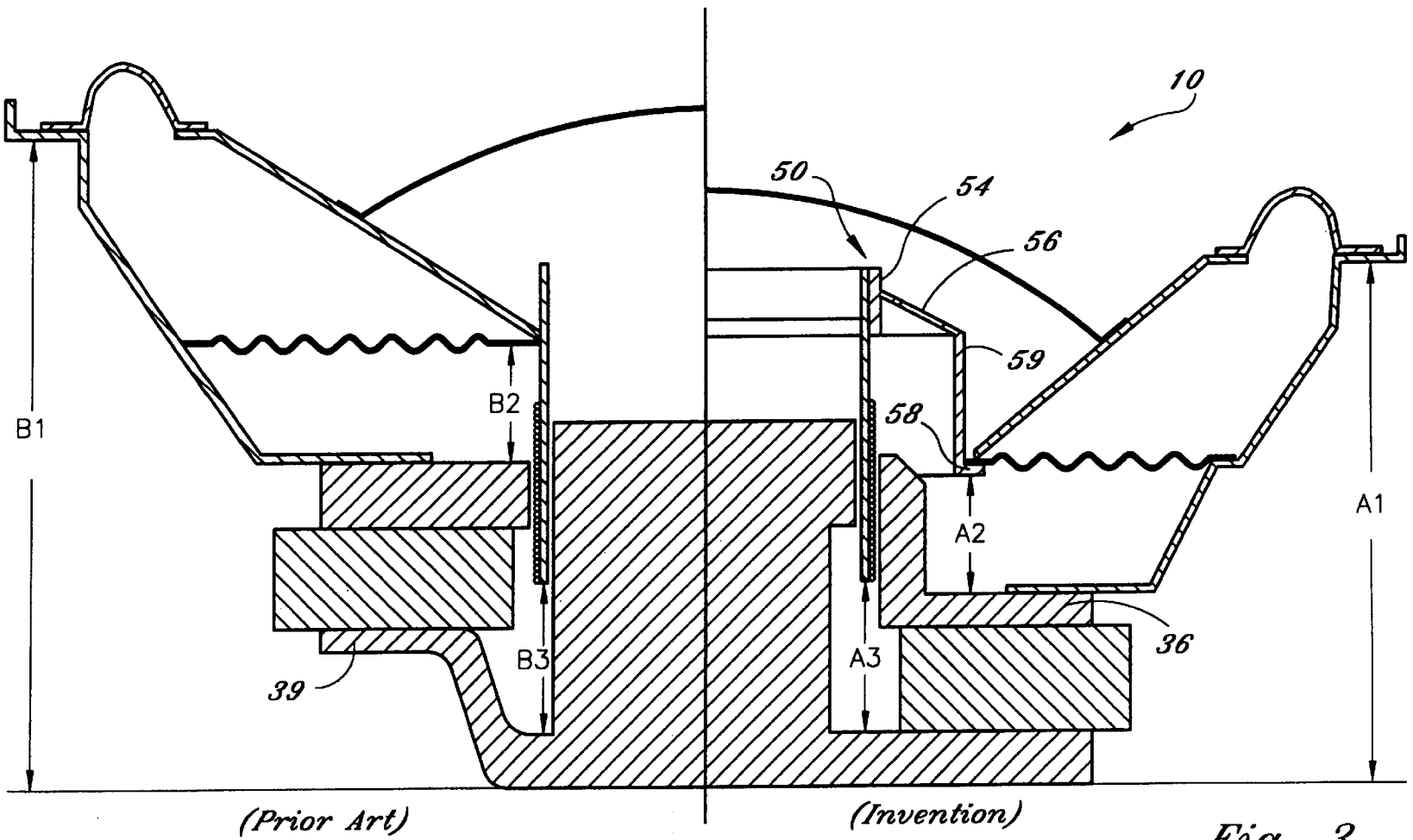
FIG. 3 depicts cross-sectional views of the instant invention (right side) and a prior art speaker (left side) side-by-side, illustrating the reduction in depth.

The loudspeaker 20 comprises a unique riser top plate 36 and adaptor ring 50. The top plate 36, in combination with the adaptor ring 50, provides for a more shallow speaker design by allowing the speaker motor structure and voice coil 40 to be moved upward into the cone volume. This is achieved without compromising excursion or changing the dimensions of the magnet 35 and pole piece 41. The top plate 36 is substantially L-shaped, whereby it has a vertical leg 36*a* and a horizontal leg 36*b*. The top plate 36 may comprise other shapes so long as it has a substantially vertical leg. The horizontal leg 36*b* rests on the magnet 35, as shown. The vertical leg 36*a* rises upward alongside the pole piece 41 and has an outside diameter which fits inside the adaptor ring 50. That is, the lower end of the adaptor ring 50 is designed to fit concentrically around the top plate vertical leg 36*a* without touching it. This allows the voice coil 40 and magnetic motor structure 35, 41, and 39 to be moved upward into the cone volume while providing the same or greater clearance between the top plate 36 and the spider 38 with respect to conventional speakers, as shown in FIG. 3. In fact, the design of the adaptor ring 50 and riser top plate 36 allows for increased speaker excursion for a shallow speaker design. The riser top plate 36 also yields higher handling power since the vertical leg 36*a* places the top plate in close proximity to the voice coil windings for more effective heat transfer.

Figure 2B:
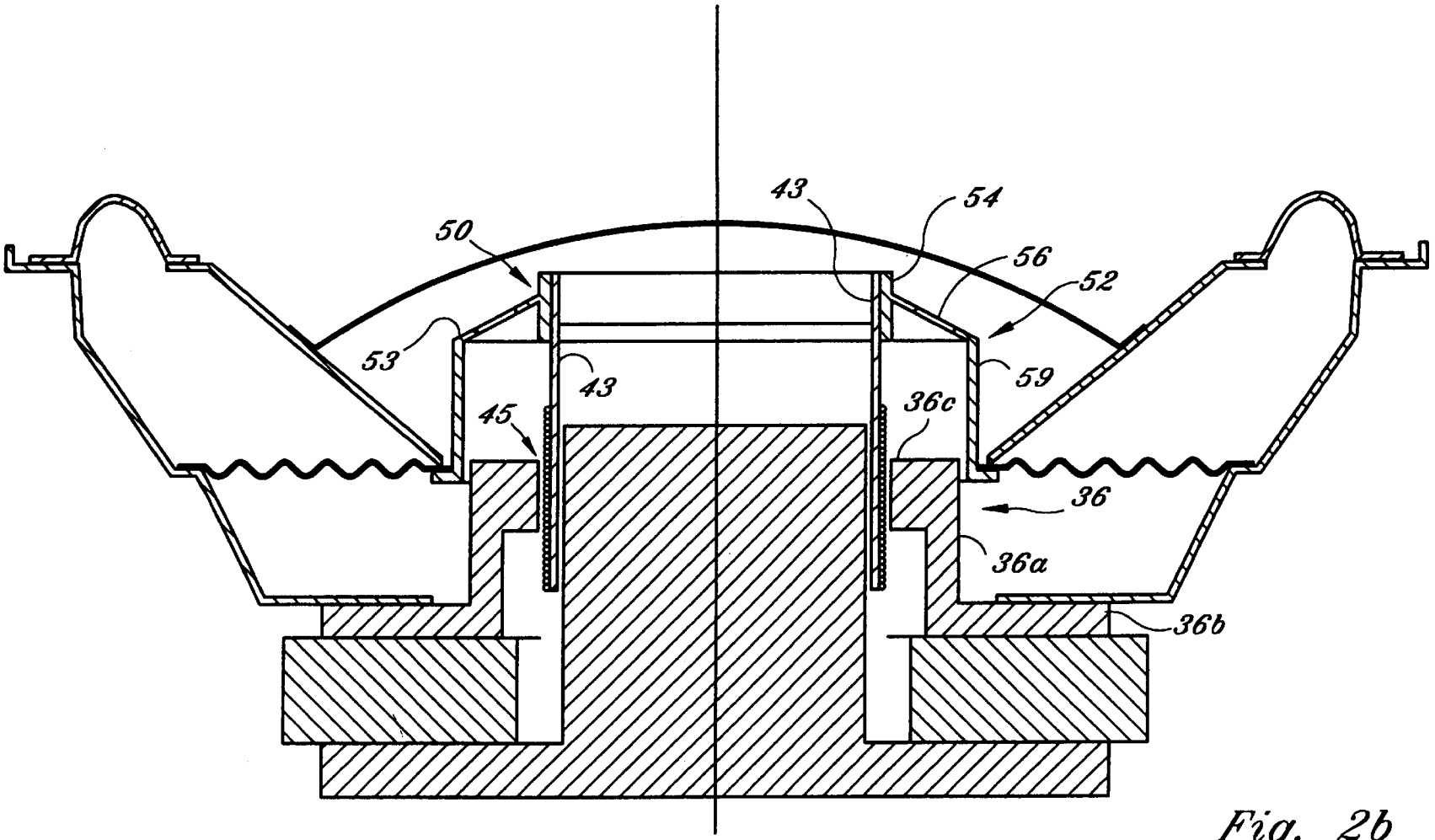
FIG. 2*b* is a cross-sectional view of an alternative embodiment of the loudspeaker and adaptor ring of the instant invention as installed in the loudspeaker.
Figure 2C:
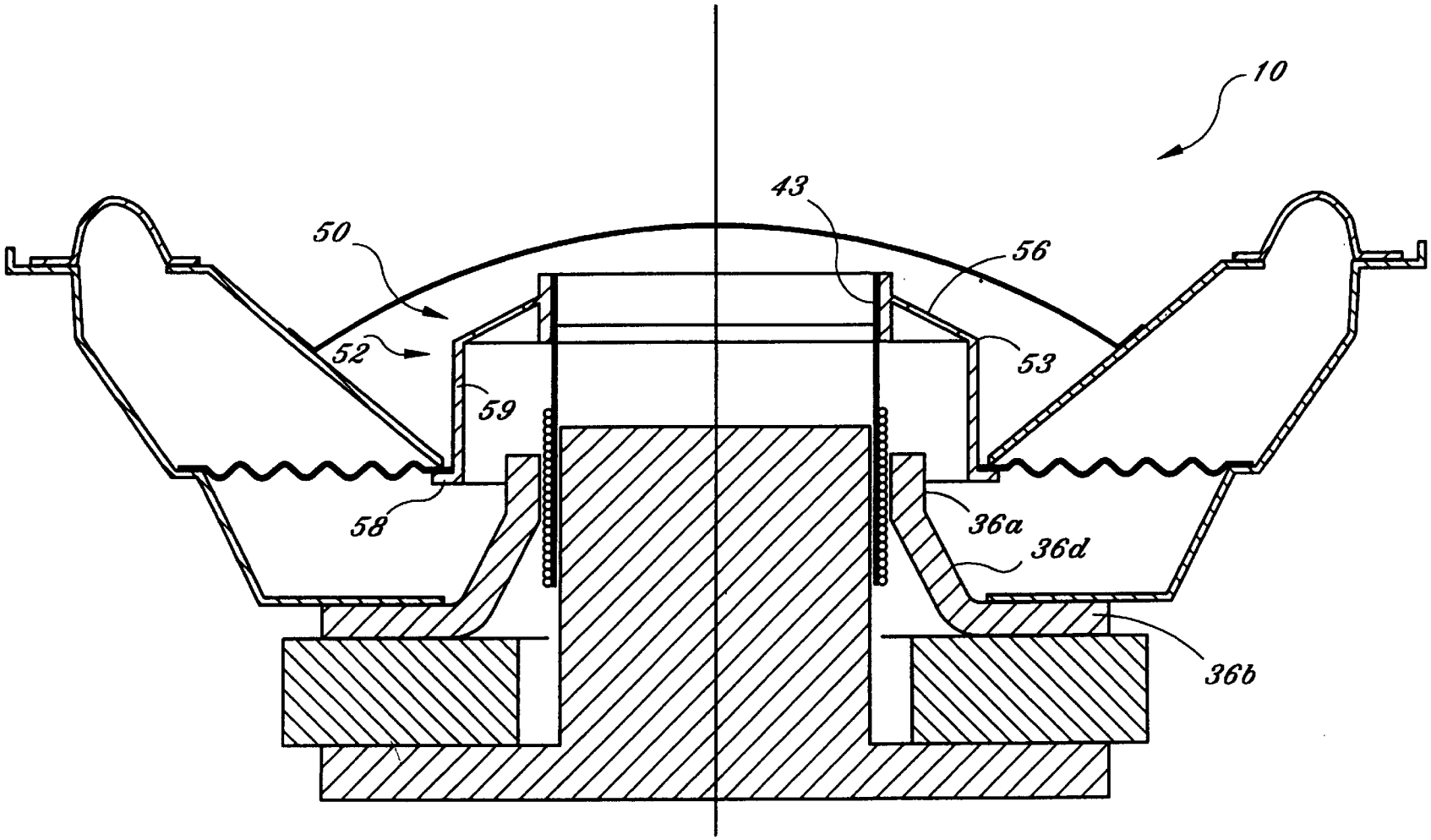
FIG. 2*c* is a cross-sectional view of a second alternative embodiment of the loudspeaker and adaptor ring of the instant invention as installed in the loudspeaker.

The riser top plate 36 may comprise other shapes in accordance with the objectives of the instant invention. With reference to FIG. 2*b*, the top plate 36 may have an inwardly facing flange 36*c*. In a second alternative as shown in FIG. 2*c*, the top plate 36 may have an angled ramp section 36*d* joining the vertical leg 36*a* and the horizontal leg 36*b*. These designs prevent or decrease leakage by inhibiting magnetic flux from jumping the magnetic gap prematurely. As shown, the adaptor ring 50 still fits concentrically over the top portion of the top plate 36. In each embodiment the riser top plate functions similarly to a bumped bottom plate by shaping the magnetic circuit so that proper clearances can be obtained. In a bumped bottom plate, rather than having a flat bottom plate coupled to a pole piece 41, the bottom plate surface is shaped as shown in the prior art drawings. This allows a voice coil to travel below the bottom surface of the magnet, preventing contact and, thus, damage. The riser top plate 36 guides the flux to a gap area 45 that is substantially removed from the magnet's top surface. This upward displacement of the magnetic gap 45 allows a coil to be mounted higher or deeper into the cone volume, alleviating the need for a heavily bumped bottom plate. This is also fortunate in that bottom plates can only be bumped so far, as today's speakers have excursions which are pushing conventional bumped bottom plates to their limit. Accordingly, the instant invention is able to maintain use of a flat bottom plate 33 while achieving its objectives with an L-shaped top plate 36.

The adaptor ring 50 and riser top plate 36 in combination (the riser top plate/adaptor system) translate the magnetic gap 45 upward while moving the spider attachment point downward. By altering the spider attachment location, the adaptor ring 50 allows the magnetic system to occupy normally unused space in the cone volume, thereby decreasing the speaker's depth. Therefore, the speaker can be made more shallow while maintaining similar performance. In addition, altering the spider attachment location provides enhanced stability to the moving assembly. The spider 38 is attached in closer vertical proximity to the voice coil's winding center. By moving the spider attachment point as shown in the drawings, the likelihood of potential contact between the moving suspension and the speaker's hard parts is decreased. This is because the configuration provides improved mechanical stability and more control or freedom in the physical design of the speaker 10.

Figure 4:
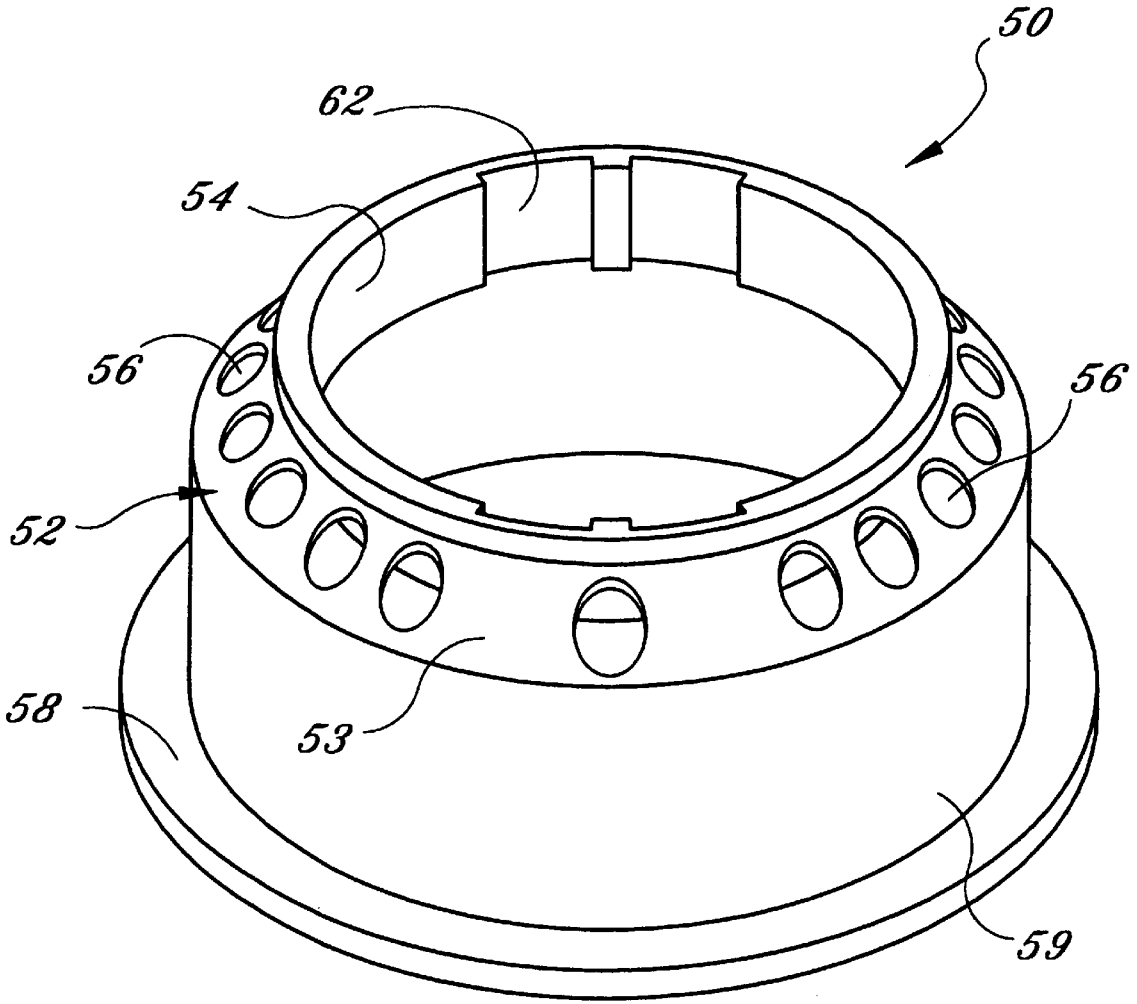
FIG. 4 is a top perspective view of the preferred adaptor ring of the instant invention.
Figure 5:
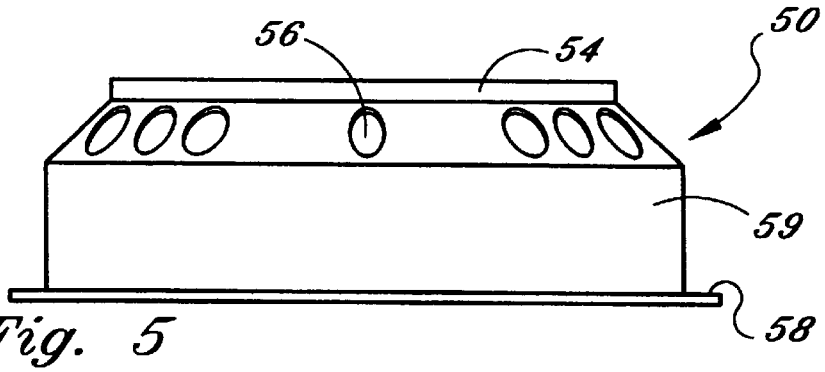
FIG. 5 is a side elevational view of the preferred adaptor ring of the instant invention.
Figure 6:
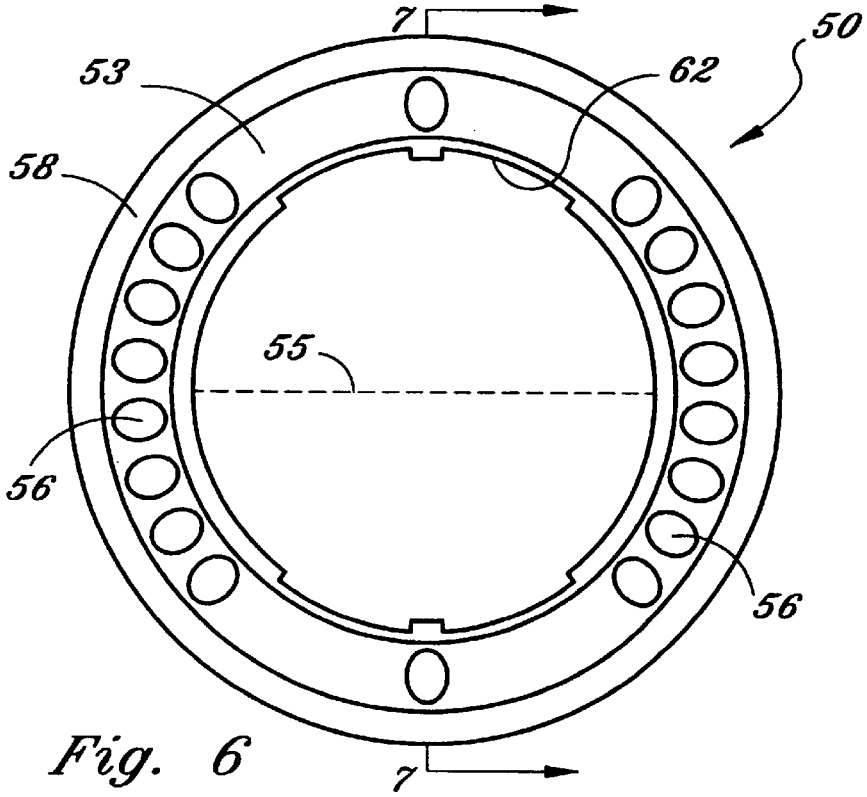
FIG. 6 is a top view of the preferred adaptor ring of the instant invention.
Figure 7:
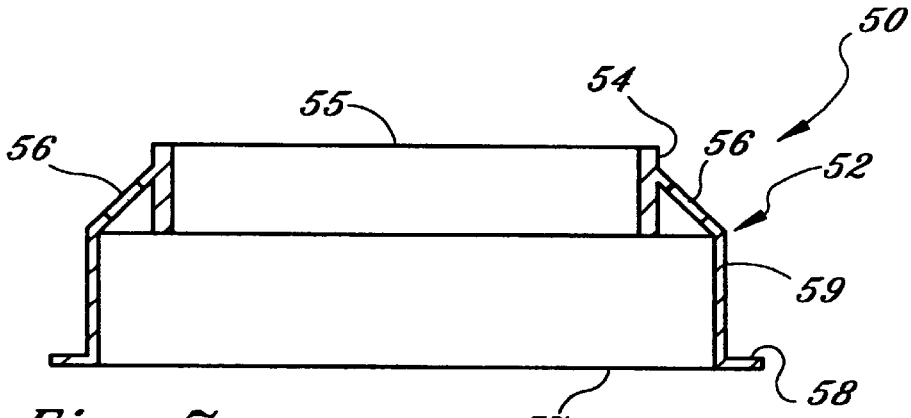
FIG. 7 is a cross-sectional view of the preferred adaptor ring of the instant invention.

Referring to FIG. 4, the preferred adaptor ring 50 preferably comprises a cylindrical wall 52 having at least one outwardly protruding ledge 58 and an upper diameter 55 which is smaller than a lower diameter 57. The ledge 58 is substantially horizontal for providing a mechanical advantage when adhering the spider and cone thereto. The ledge 58 may also be angled without departing from the scope and spirit of the invention. An additional ledge may be provided for mounting the cone 24. Since the adaptor ring 50 has an upper and lower diameter, the adaptor ring may be described as having an upper collar 54 and a lower collar 59 joined by at least one cross member 53 defining a plurality of venting passages. The adaptor ring 50 may also comprise at least one venting passage 56, an upper tapered wall extension 53 (cross-member), and an upper lip 54 defining the upper diameter 55. The venting passages 56 are defined by the tapered wall extension/cross-member 53. These venting passages 56, or additional vents, may be provided in the cylindrical wall 52, the former 43, the frame 22, or the pole piece 51. In addition, the venting passages 50 may be sized and positioned to create a Venturi effect for drawing trapped air from the cone volume. To complete venting, the spider 38 is preferably porous and the frame 22 is vented. The adaptor ring 50 may be manufactured by plastic injection molding, metal die casting, or similar manufacturing techniques.

With reference to FIG. 3, one-half of a prior art speaker is shown in cross section alongside one-half of the inventive speaker 10 shown in cross section. This illustrates the difference in mounting depth between conventional speakers and speakers employing the riser top plate and adaptor ring structures. The mounting depth A1 of the inventive speaker 10 is smaller than the mounting depth B1 of comparable conventional speakers. The adaptor ring 50 and riser top plate 36 accomplish decreased mounting depth without sacrificing clearance between the top plate 36 and spider 38. It should be noted that the dimensions for the speaker components noted below remain constant to show the improved or decreased mounting depth. That is, the roll 28, cone depth 24, clearance between the spider 38 and top plate 36, clearance A2, B2 between the adaptor ring 50 and top plate 36, voice coil winding length, effective top plate thickness, excursion, magnetic thickness, back plate 39 thickness at the pole piece, and the clearance A3, B3 between the voice coil 40 and back plate 39, are held constant to specifically show mounting depth difference. With the above dimensions being held constant, the two speakers are essentially identical except for the small increase in mass due to the adaptor ring 50. However, there is a marked difference in mounting depth A1, B1 between the two topologies. The riser top plate/adaptor system of the invention allows identical excursion performance with reduced mounting depth.

In an alternative embodiment, the adaptor ring 100 comprises a tapered sleeve having substantially cylindrical and tapered walls that simultaneously attaches to the voice coil 40 and fits over the riser top plate vertical leg 36*a*, as shown in FIGS. 8–13. The tapered design of the adaptor ring 100 can be achieved in alternative ways, as illustrated in the drawings. With reference to FIGS. 8–11, the alternative adaptor ring 100 comprises an upper collar 102, a lower collar 104, main support braces 110, alignment ribs 116, vents 106, and at least one support ledge 108. Like the preferred adaptor ring 50, the upper collar 102 defines a first diameter which is smaller than the diameter defined by the lower collar 104. The lower collar 104 has a diameter which allows it to fit over the riser top plate vertical leg 36*a* without touching it. The upper collar 102 has a diameter which is adapted for receiving and securing the voice coil former 43. The upper and lower collars 102, 104 are joined, separated, and aligned by a plurality of alignment ribs 116 and the main support braces 110.

The upper collar 102 has a tapered lower edge 118 for receiving and attaching the voice coil former 43. The upper edge of the voice coil former 43 may be attached to the former receiving edge 118. The former 43 may also be tapered to correspond to the former receiving edge 118. The former 43 is preferably attached to the inner diameter of the upper collar 102. Preferably the former 43 is adhered to the upper collar 102, but may be attached thereto by other methods known in the art, such as soldering or hardware. An inherent gap exists between the collar 102 and former 43 for receiving an adhesive and adhering the former 43 to the upper collar 102. In the alternative, the adaptor ring 100 and former 43 may comprise an integral part which may be fabricated by plastic injection molding techniques or metal die casting.

Figure 8:
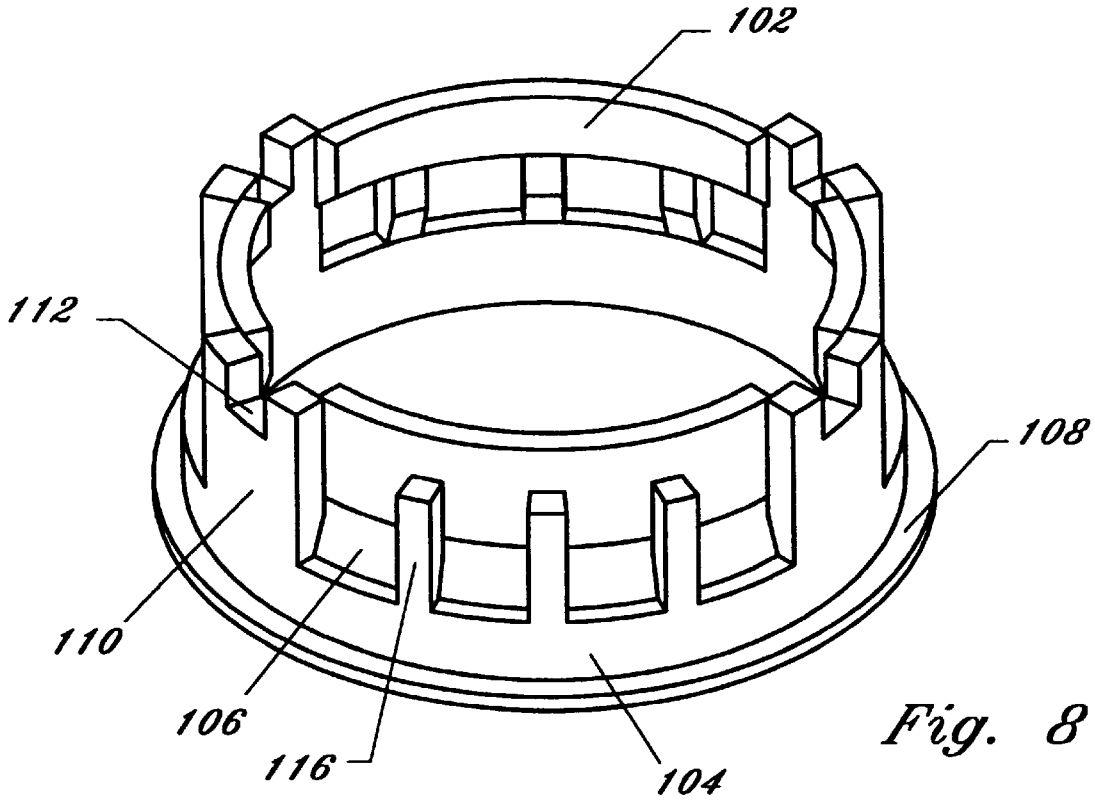
FIG. 8 is a top perspective view of the alternative embodiment of the voice coil adaptor of the instant invention.
Figure 9:
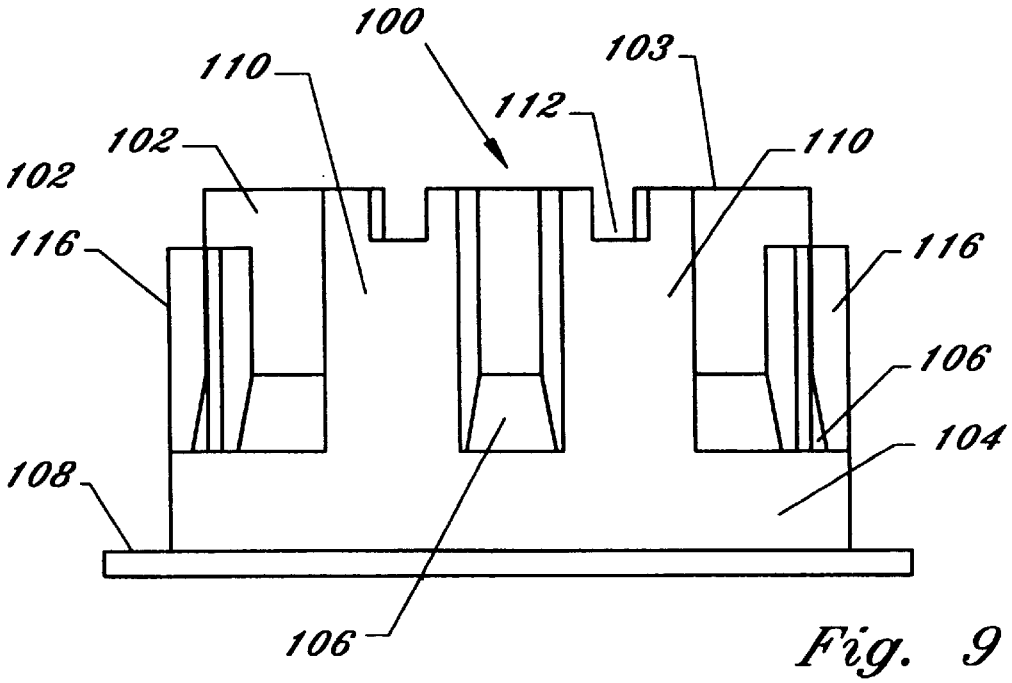
FIG. 9 is a side view of the alternative voice coil adaptor of the instant invention.
Figure 10A:
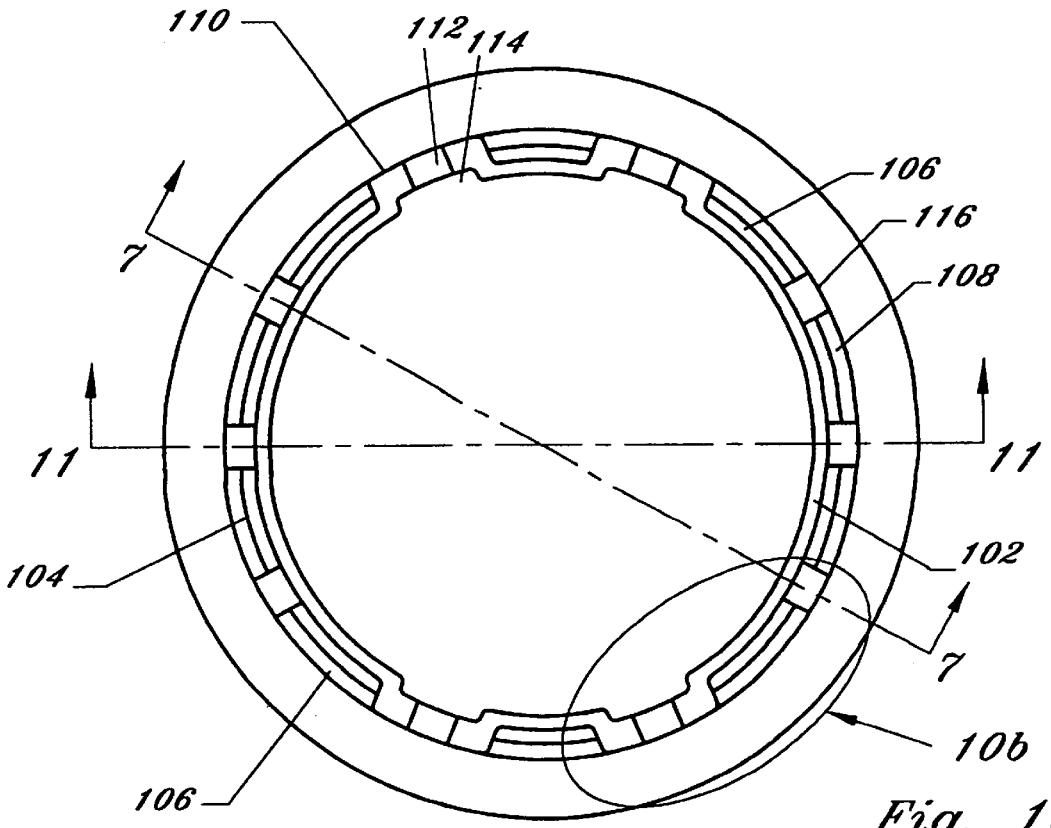
FIG. 10*a* is a top planar view of the alternative voice coil adaptor ring of the instant invention.
Figure 10B:
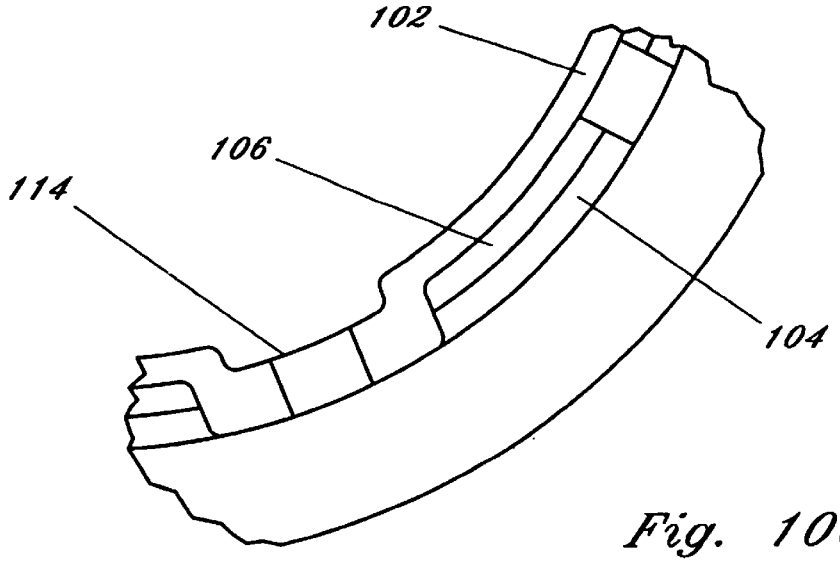
FIG. 10*b* is an enlarged detailed top view of a portion of the alternative adaptor ring to further illustrate the relationship of the elements.

The lower collar 104 has a larger diameter than the upper collar 102, such that the adaptor ring 100 appears to be tiered, as shown in FIGS. 8 and 9. The lower collar 104 has an inner diameter that fits around the riser top plate 36 without touching it. The support ledge 108 preferably projects radially outward from the lower collar and is substantially horizontal. The support ledge 108 receives and supports the spider 38 which is preferably adhered thereto. The cone 24 is also adhered to the ledge 108. In the alternative, a second ledge may project from the adaptor ring 100 for receiving, supporting, and adhering the cone 24.

Figure 11:
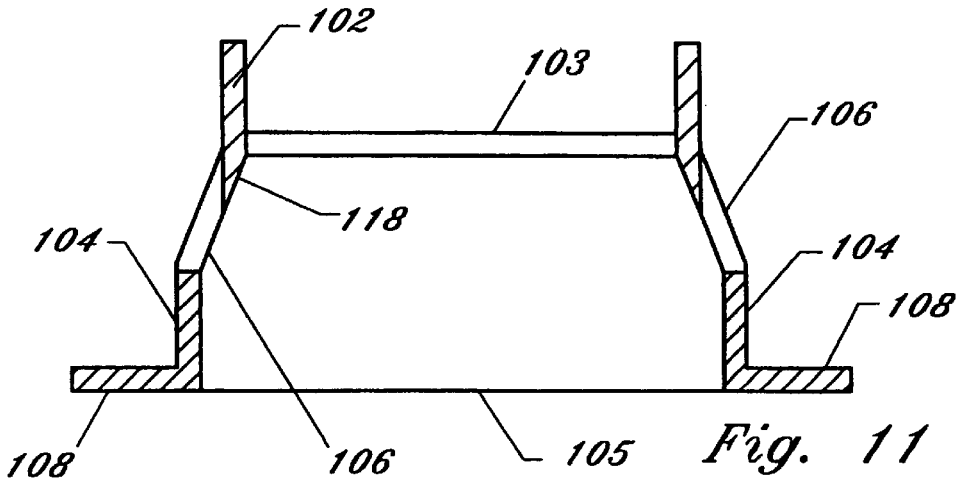
FIG. 11 is a cross-sectional view of the alternative voice coil adaptor ring of the instant invention taken along line 11—11 of FIG. 10.

The upper and lower collars 102, 104 are joined by main support braces 110 and a plurality of alignment ribs 116. The main support braces 110 extend from the lower collar 104 to the top edge of the upper collar 102. Each brace 110 has a wire notch 112 for routing the wire leads from the voice coil winding. A wire channel 114 is defined by the interior surface of each support brace 110 and the upper collar 102. The wire leads rest in the channel and extend outside the adaptor ring through the wire notch 112. The alignment ribs 116 help to align and position the upper and lower collars 102, 104. Venting passages 106 are defined between each rib 116 and between the main support braces 110. The main braces 110 and support ribs 116 may taper from the upper collar 102 to the lower collar 104 so that the collars are concentrically offset. That is, the upper collar has an outer diameter which is smaller than the inner diameter of the lower collar, and the upper collar is positioned a predetermined distance above the lower collar. Accordingly, the venting passages have a horizontal component, as well as a vertical component, as shown in FIG. 11.

The venting passages 106 are defined by the upper collar 102, lower collar 104, support braces 110, and alignment ribs 116, as noted above. The venting passages 106 are angled to improve ventilation.

With reference to all embodiments, the venting passages eliminate the need for a pole vent 42. The conventional pole vent is required in the background art to vent heat and air pressure build up in the cone volume. The voice coil adaptor ring 50, 100 of the instant invention eliminates the pole vent by including the venting passages in the adaptor ring, as discussed above. The venting passages comprise channels bored completely through the cylindrical wall. Replacing the conventional pole vent with the adaptor ring vent passages saves machining in the pole piece structure 41 so as to reduce costs. A solid pole piece 41 also increases magnetic circuit efficiency and provides an improved thermal path for heat transfer from the voice coil. By allowing for improved heat transfer from the voice coil, the driver may be operated at a higher power rating.

The alternative adaptor ring 100 also defines at least one exterior ledge 108. As with the preferred adaptor ring 50, the ledge 108 is preferably planar, or substantially horizontal, such that it provides a ledge for receiving and securing the spider suspension 38 and/or the neck/lower edge of the speaker cone 24, The ledge 58, 108 preferably supports the inner edge of the spider 38 and provides enough surface area for applying adhesives between the spider 38 and the ledge 58, 108 so as to firmly secure the spider in place. Adhesives may also be applied to the upper surface of the spider 38 for adhering the neck of the cone 24. The instant invention is superior to the background art, whereby the ledge provides a more stable securing structure than the vertical surface of the voice coil former 43. In addition, it provides a structure that enables the joining of the cone 22 and spider 38 for a stronger joint. The adaptor ring and ledge also provide a mechanical stop for the cone's 24 lower edge providing a more reliable joint. When the cone 24 is attached to the top of the spider 38, the spider 38 is completely locked in place. Attaching the spider 38 and cone 24 to the voice coil adaptor ring 50, 100 along a larger circumferential planar surface provides more contact area for applying epoxy. This additional contact area alleviates stress on the glue joints via improved stress distribution for increased reliability. Consequently, the spider/cone/voice coil joint is virtually eliminated as a possible point of failure in the loudspeaker. In the alternative, the surface of the ledge 108 and/or the entire adaptor ring can be textured or ribbed to enhance adhesion.

The voice coil adaptor 50, 100 facilitates use of a corrugated spider 38 having a larger inner diameter in the area of its mid-section. A spider with a large inner diameter is amenable with the instant invention because of the additional security provided by the voice coil adaptor ring 50, 100 and ledge 58, 108. That is, because more spider material is adjacent to the glue joint in a loudspeaker using the voice coil adaptor, spider fatigue is less of a concern. As noted, a larger inner diameter spider 38 is more resistant to rocking that may incur in a loudspeaker. With the use of the adaptor ring 50, 100, the spider material deflection is increased for a given degree of coil rotation making the spider more resistant to rocking. The additional stability provided by the adaptor ring and corrugated spider 38, make the speaker more reliable and facilitate larger excursions. The improved centering force allows for tightened tolerances in the magnetic gap as defined between the riser top plate 37 and pole piece for improved speaker performance. Maintaining a smaller magnetic gap increases the motor strength and enhances the thermal power handling of the loudspeaker.

The adaptor ring 50, 100 moves the contact point of the lower cone edge outward. As a result, the cone angle is decreased, with reference to a vertical axis, for higher strength and rigidity. As a result, the cone 24 is not only more reliably stabilized, but may be manufactured from a thinner material reducing the cone's weight and audible coloration.

Figure 12:
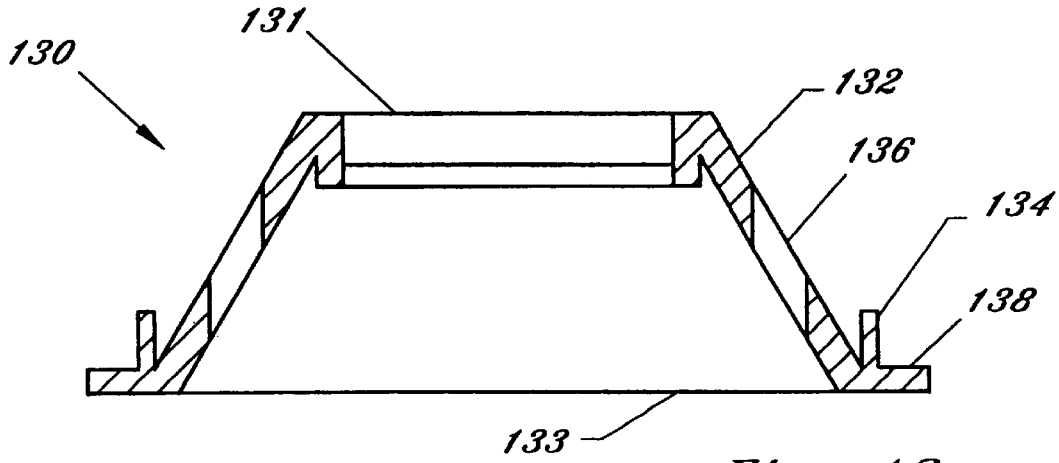
FIG. 12 is a cross-sectional view of another embodiment of the adaptor ring of the instant invention.

In another alternative, the adaptor ring 130 may comprise a tapered, cylindrical sleeve formed by a uniform wall as shown in FIG. 12. The alternative adaptor ring 130 has an inner diameter 131 that attaches and secures the voice coil former 43 to the adaptor ring 130. The alternative adaptor ring 130 also includes a ledge 138, venting passages 136, and a vertical support extending upward from the ledge 138. The lower end of the adaptor ring defines an inner diameter 133 which is large enough for fitting over the riser top plate vertical leg 36*a*.

All embodiments of the adaptor ring of the instant invention may be manufactured from plastic using known injection molding techniques or metal die casting. Consequently, the ribs 116, support braces 110, and the ledge 108 may comprise integral components of the adaptor ring 50 of the instant invention.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A loudspeaker, comprising:

a flame, a voice coil including a former carrying a wire winding, a diaphragm and a lower suspension;

a motor structure including a top plate, a back plate, a magnet connected between said top plate and back plate, and a pole piece concentrically disposed within a bore formed by said top plate and said magnet defining a magnetic gap therebetween, said top plate being formed with a leg extending vertically upwardly from said magnet and spaced from said pole piece;

an adaptor ring including a wall having a first end, a second end, an inner surface defining a hollow interior and an outer surface spaced from said inner surface;

said former of said voice coil being received within said hollow interior of said wall of said adaptor ring and being connected to said inner surface of said wall, said diaphragm and said lower suspension being connected between said frame and outer surface of said wall;

said wall of said adaptor ring being formed with at least one passage located in between said inner surface and said outer surface thereof for venting air.

2. The loudspeaker of claim 1 in which said leg of said top plate has an upper end located substantially in alignment with said second end of said wall of said adaptor ring.

3. The loudspeaker of claim 1 in which said leg of said top plate is a substantially cylindrical in shape wall defining a hollow interior, said wire winding of said voice coil being spaced from and extending along said leg.

4. The loudspeaker of claim 3 in which said leg hias a substantially constant diameter from said magnet to said upper end thereof.

5. The loudspeaker of claim 3 in which said leg has a reduced diameter at a location adjacent said upper end thereof.

6. The loudspeaker of claim 3 in which said leg is substantially parallel to said pole piece from said magnet to said upper end thereof.

7. The loudspeaker of claim 1 in which said top plate includes a base section connected to said leg, said base section being connected to said magnet and said leg extending radially inwardly from said base portion to a location spaced from said voice coil.

8. The loudspeaker of claim 7 in which said leg includes a substantially cylindrical-shaped upper portion, and an angled portion extending between said base section and said upper portion.

9. The loudspeaker of claim 1 in which said passage of said adaptor ring extends between said first end and said second end of said wall thereof.

10. The loudspeaker of claim 1 in which said passage of said adaptor ring comprises a number of passages spaced from one another along said wall thereof.

11. The loudspeaker of claim 1 in which said wall of said adaptor ring is substantially cylindrical in shape, said passage comprising a number of circumferentially spaced passages formed in said wall thereof.

* * * * *